US008172009B2

(12) United States Patent
Hall et al.

(10) Patent No.: US 8,172,009 B2
(45) Date of Patent: May 8, 2012

(54) EXPANDABLE TOOL WITH AT LEAST ONE BLADE THAT LOCKS IN PLACE THROUGH A WEDGING EFFECT

(76) Inventors: David R. Hall, Provo, UT (US); Jonathan Marshall, Provo, UT (US); Scott Dahlgren, Alpine, UT (US)

( * ) Notice: Subject to any disclaimer, the term of this patent is extended or adjusted under 35 U.S.C. 154(b) by 0 days.

(21) Appl. No.: 13/012,564

(22) Filed: Jan. 24, 2011

(65) Prior Publication Data

US 2012/0012398 A1 Jan. 19, 2012

Related U.S. Application Data

(63) Continuation-in-part of application No. 12/836,564, filed on Jul. 14, 2010.

(51) Int. Cl.
*E21B 10/32* (2006.01)
*E21B 7/28* (2006.01)

(52) U.S. Cl. ..... 175/284; 175/263

(58) Field of Classification Search ..... 175/272, 175/284, 263, 281; 166/55.6
See application file for complete search history.

(56) References Cited

U.S. PATENT DOCUMENTS

| | | | |
|---|---|---|---|
| 1,921,135 | A | 8/1933 | Santiago |
| 2,170,452 | A | 8/1939 | Grant |
| 2,427,052 | A | 9/1947 | Grant |
| 3,126,065 | A | 3/1964 | Chadderdon |
| 3,703,104 | A | 11/1972 | Tamplen |
| 3,823,773 | A | 7/1974 | Nutter |
| 3,986,554 | A | 10/1976 | Nutter |
| 4,081,042 | A | 3/1978 | Johnson |
| 4,491,187 | A | 1/1985 | Russell |
| 4,655,289 | A | 4/1987 | Schoeffler |
| 4,895,214 | A | 1/1990 | Schoeffler |
| 5,230,390 | A | 7/1993 | Zastresek |
| 5,316,094 | A | 5/1994 | Pringle |
| 5,499,687 | A | 3/1996 | Lee |
| 5,553,678 | A | 9/1996 | Barr |
| 5,609,178 | A | 3/1997 | Hennig |
| 5,673,763 | A | 10/1997 | Thorp |
| 5,685,379 | A | 11/1997 | Barr |
| 5,695,015 | A | 12/1997 | Barr |
| 5,706,905 | A | 1/1998 | Barr |
| 5,730,222 | A | 3/1998 | Rike |
| 5,803,185 | A | 9/1998 | Barr |
| 6,003,606 | A | 12/1999 | Moore et al. |
| 6,089,323 | A | 7/2000 | Newman et al. |
| 6,089,332 | A | 7/2000 | Barr |
| 6,142,250 | A | 11/2000 | Griffin |
| 6,717,283 | B2 | 4/2004 | Skinner |

(Continued)

*Primary Examiner* — Daniel P Stephenson
(74) *Attorney, Agent, or Firm* — Philip W. Townsend, III

(57) ABSTRACT

In one aspect of the present invention, an expandable tool for an earth boring system comprises a mandrel with a sleeve positioned around the outer surface and a blade disposed in a slot formed in the sleeve. The sleeve is also configured to slide along the tubular body. The blade comprises an interior slide groove located on an interior surface and an exterior slide groove located on an exterior surface. A sleeve protrusion is configured to extend into the interior slide groove, while a mandrel protrusion is configured to extend into the exterior slide groove. The blade is configured to shift laterally out of the slot as the sleeve slides axially, wherein the interior and exterior slide grooves are oriented at different angles and as the sleeve slides axially along the length of the mandrel, the slide grooves lock the blade in a pre-determined position through a wedging effect.

17 Claims, 9 Drawing Sheets

U.S. PATENT DOCUMENTS

| | | | | |
|---|---|---|---|---|
| 6,732,817 | B2 | 5/2004 | Dewey | |
| 6,854,953 | B2 | 2/2005 | Van Drentham-Susman | |
| 7,036,611 | B2 | 5/2006 | Radford | |
| 7,048,078 | B2 | 5/2006 | Dewey | |
| 7,252,163 | B2 * | 8/2007 | Ollerenshaw et al. | 175/269 |
| 7,275,593 | B2 | 10/2007 | Bloom et al. | |
| 7,308,937 | B2 | 12/2007 | Radford | |
| 7,314,099 | B2 | 1/2008 | Dewey et al. | |
| 7,665,550 | B2 * | 2/2010 | Rives | 175/406 |
| 7,891,441 | B2 * | 2/2011 | Lee | 175/267 |
| 2005/0145417 | A1 | 7/2005 | Radford | |
| 2007/0163808 | A1 * | 7/2007 | Campbell et al. | 175/57 |
| 2008/0105464 | A1 | 5/2008 | Radford | |
| 2008/0128175 | A1 | 6/2008 | Radford et al. | |
| 2010/0276201 | A1 * | 11/2010 | Makkar et al. | 175/57 |

* cited by examiner

EXPANDABLE TOOL WITH AT LEAST ONE BLADE THAT LOCKS IN PLACE THROUGH A WEDGING EFFECT

CROSS REFERENCE TO RELATED APPLICATIONS

This application is a continuation-in-part of U.S. patent application Ser. No. 12/836,564, which was filed on Jul. 14, 2010 and entitled Expandable Tool for an Earth Boring System. U.S. patent application Ser. No. 12/836,564 is herein incorporated by reference for all that it contains.

BACKGROUND OF THE INVENTION

The present invention relates to the fields of downhole oil, gas, and/or geothermal exploration and more particularly to the fields of expandable tools for downhole exploration. The prior art discloses expandable tools used to enlarge the diameter of a wellbore during drilling operations. Expandable tools of this type may contain blades which extend from the sides of a drill string and contact the well bore wall.

U.S. Pat. No. 7,314,099 to Dewey et al., which is herein incorporated by reference for all it contains, discloses an expandable downhole tool comprising a tubular body having an axial flow bore extending there through, at least one moveable arm, and a selectively actuatable sleeve that prevents or allows the at least one moveable arm to translate between a collapsed position and an expanded position. A method of expanding the downhole tool comprises disposing the downhole tool within the wellbore, biasing the at least one moveable arm to a collapsed position corresponding to an initial diameter of the downhole tool, flowing a fluid through an axial flow bore extending through the downhole tool while preventing the fluid from communicating with a different flow path of the downhole tool, allowing the fluid to communicate with the different flow path by introducing an actuator into the wellbore, and causing the at least one moveable arm to translate to an expanded position corresponding to an expanded diameter of the downhole tool.

U.S. Patent App. 2008/0128175 to Radford, et al., which is herein incorporated by reference for all that it contains, discloses an expandable reamer apparatus for drilling a subterranean formation including a tubular body, one or more blades, each blade positionally coupled to a sloped track of the tubular body, a push sleeve and a drilling fluid flow path extending through an inner bore of the tubular body for conducting fluid there through. Each of the one or more blades includes at least one cutting element configured to remove material from a subterranean formation during reaming. The push sleeve is disposed in the inner bore of the tubular body and coupled to each of the one or more blades so as to effect axial movement thereof along the track to an extended position responsive to exposure to a force or pressure of drilling fluid in the flow path of the inner bore.

BRIEF SUMMARY OF THE INVENTION

In one aspect of the present invention, an expandable tool for an earth boring system comprises a mandrel comprising a tubular body with an outer surface. A sleeve is positioned around the outer surface and comprises a blade disposed in a slot formed in the thickness of the sleeve. The sleeve is also configured to slide axially along a length of the tubular body. The blade comprises an interior slide groove located on an interior blade surface and an exterior slide groove located on an exterior blade surface. A sleeve protrusion of the sleeve is configured to extend into the interior slide groove, while a mandrel protrusion of the outer surface of the mandrel is configured to extend into the exterior slide groove. The blade is configured to shift laterally out of the slot as the sleeve slides axially. The interior and exterior slide grooves are oriented at different angles and as the sleeve slides axially along the length of the mandrel, the slide grooves lock the blade in a pre-determined position through a wedging effect.

The difference in the angles between the sleeve protrusion and the mandrel protrusion may contribute to forming the wedging effect. The wedging effect may cause the blade to stiffen a connection between the slide grooves and the protrusions, holding the blade rigid. The protrusions may be configured to produce an increasing wedging effect on the slide grooves. The wedging effect may be configured to increase the pressure of the blade against a borehole wall. Also, a low power electrical control system may be configured to shift the blade.

The blade may comprise an leading edge formed on a leading edge of the blade. The leading edge may comprise a plurality of sensors. The plurality of sensors may be distributed along a radius of curvature similar to a radius of curvature of the leading edge.

The mandrel may comprise a fin formed on the outer surface of the mandrel. The mandrel protrusion may be formed on the fin. The fin may be configured to immobilize the interior slide groove when the blade is in the locked position. A portion of interior surface of the blade may be configured to slide along an outward face of the fin.

The exterior slide groove and the sleeve protrusion may be angled between 70 and 110 degrees with the axis of the mandrel while the interior slide groove and the mandrel protrusion may be angled between 10 and 30 degrees.

DETAILED DESCRIPTION OF THE INVENTION AND THE PREFERRED EMBODIMENT

Figure 1:
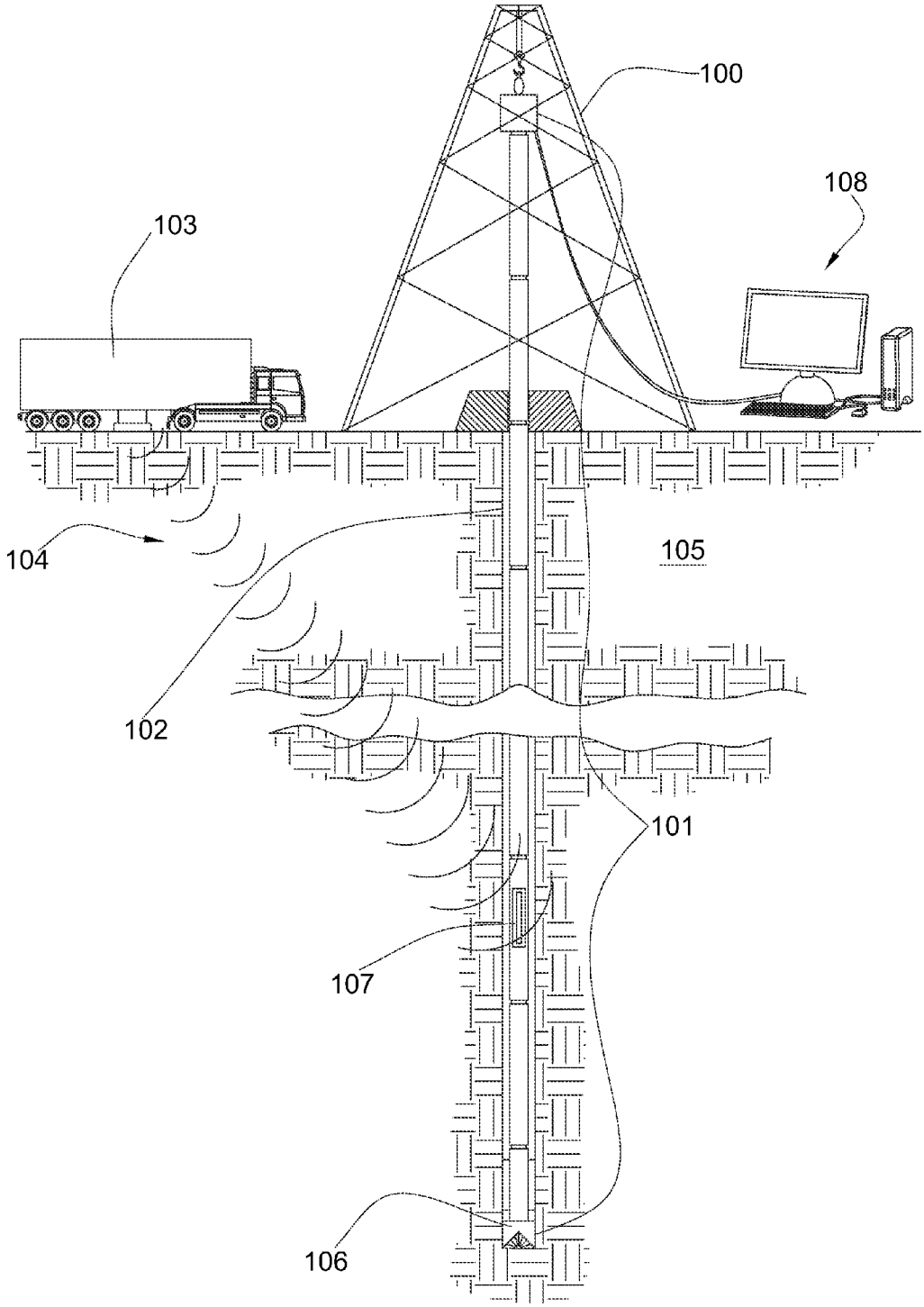
FIG. 1 is a cutaway view of an embodiment of a drilling operation.

FIG. 1 discloses a cutaway view of an embodiment of a drilling operation comprising a drilling derrick 100 supporting a drill string 101 inside a borehole 102 and a thumper truck 103 designed to create seismic and/or sonic waves 104 in an earthen formation 105. The drill string 101 may comprise a bottom hole assembly 106, including; electronic equipment and an expandable tool 107. The electronic equipment may receive seismic and/or sonic waves 104 through the earthen formation 105 and send signals through a data communication system to a computer or data logging system 108 located at the surface. In other embodiments, the data communication system is capable of two way communication, and the computer 108 may generate, process, and/or send commands to the expandable element. In some embodiments, wireless signals may be picked up by the data communication system, such as Bluetooth, short hop, infrared, radio, and/or satellite signals.

The expandable tool 107 may be configured to rotate in the borehole 102. Rotating the drill string 101 may also rotate the drill bit and cause the drill bit to degrade the bottom of the borehole 102. Degrading the borehole 102 may shake the drill string 101 and accompanying parts about the borehole 102. The expandable tool 107 may be configured to limit the shaking by expanding and stabilizing the drill string 101.

Figures 2A, 2B:
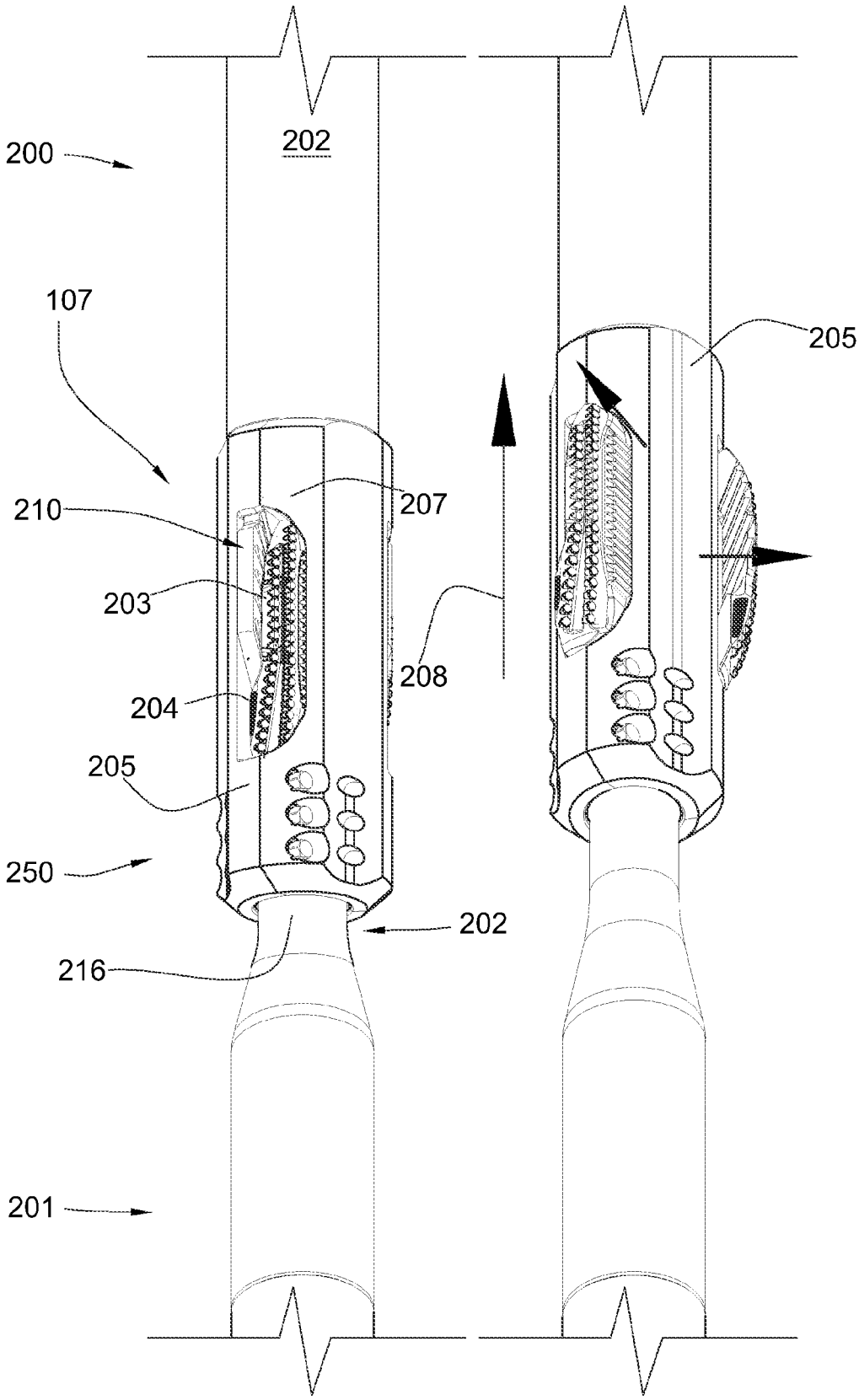
FIG. 2*a* is an orthogonal view of an embodiment of a downhole tool.
FIG. 2*b* is an orthogonal view of an embodiment of a downhole tool.

FIG. 2*a* discloses a perspective view of an embodiment of the expandable tool 107. An upper end 200 of the expandable tool may connect other downhole tool string components at tool joints. A lower end 201 of the tool may connect directly to a bottom hole assembly 106, drill bit, or other drill string components. In this embodiment, the expandable tool 107 may comprise a mandrel 202 comprising a tubular body and an outer surface 206, a plurality of blades 203 disposed around the mandrel's outer surface 206, a plurality of sensors 204 disposed on the blade 203, a fin 210, and a slidable sleeve 205.

The slidable sleeve 205 comprises the blade 203 disposed in a slot formed in the thickness of the sleeve 205. A plurality of axial segments 250 may form the slidable sleeve 205. The blade 203 may comprise a plurality of cutting elements 207 and be configured to ream the borehole wall 102. The blade 203 is depicted in the embodiment of FIG. 2*a* in a retracted position.

FIG. 2*b* discloses a perspective view of an embodiment of the expandable tool 107. The slidable sleeve 205 and the blade 203 may be connected such that as the slidable sleeve 205 slides along the mandrel 202 in the direction of arrow 208, the blade 203 shifts laterally out of the slot. Sliding the sleeve 205 in the reverse direction may result in retracting the expandable tool 107. When the blade 203 is in an expanded position it may become engaged with the bore wall of the earthen formation 105.

Figure 3:
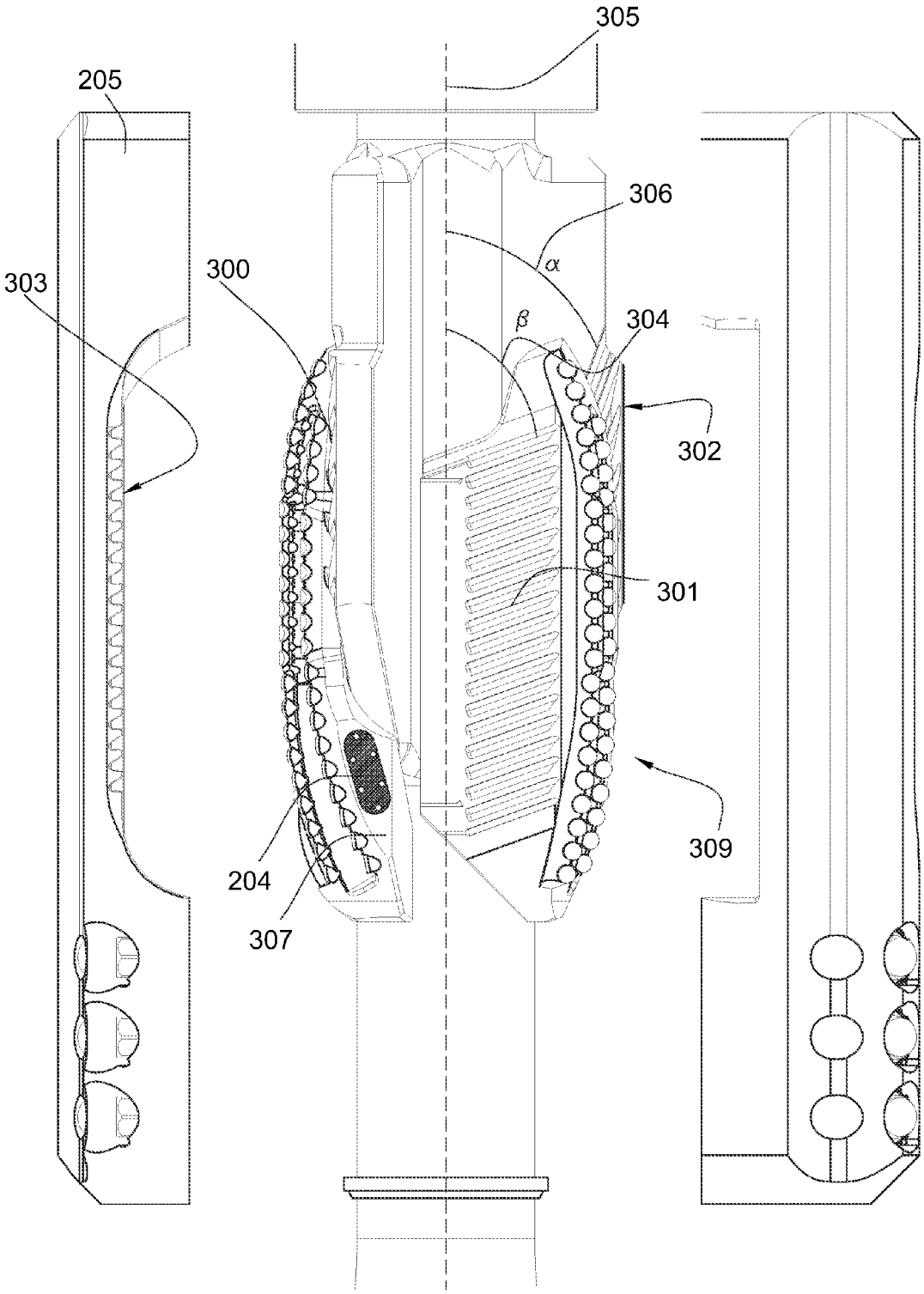
FIG. 3 is a perspective view of another embodiment of a downhole tool.

FIG. 3 discloses an exploded view of an embodiment of the expandable tool 107. The slidable sleeve 205 is exploded away from the mandrel 202 and the blade 203. The blade 203 comprises an interior slide groove 300 located on an interior blade surface and an exterior slide groove 301 located on an exterior blade surface. The interior slide groove 300 is configured to extend into a mandrel protrusion 302 located on the fin 210. The exterior slide groove 301 is configured to extend into a sleeve protrusion 303 disposed on the slidable sleeve 205.

The sleeve protrusion 303 may be configured to complement an exterior slide groove 301 and both the sleeve protrusion 303 and the exterior slide groove 301 may be offset an angle β 304 from the axis of the mandrel 305. The angle β 304 may be angled between 70 and 110 degrees. The fin's mandrel protrusion 302 may complement an interior slide groove 300 located on the blade 203 at an angle of α 306 relative to the mandrel's axis 305. The angle α 306 may be angled between 10 and 30 degrees with respect to an axis 305 of the mandrel.

The difference in angles α 306 and β 304 cause the slide grooves 300, 301 and the protrusions 302, 303 to tighten as the blade 203 extends, which is referred to in this application as a wedging effect. The wedging effect may lock the blade in a pre-determined position. As the blade 203 shifts laterally out of the slot in the sleeve 205, the wedging effect 400 may increase in strength, thereby stiffening the blade as it extends. When the blade 203 is fully extended, the wedging effect may hold the blade 203 rigidly.

When the expandable tool 107 is fully contracted, a connection between the slide grooves 300, 301 and the protrusions 302, 303 may be loosely correlated. As the blade 203 extends, the difference in angles between the sleeve protrusion 303 and the mandrel protrusion 302 may contribute to the wedging effect. The tightening of the protrusions 302, 303 into the slide grooves 300, 301 may increase the inflexibility of the extended expandable tool 107.

The blade 203 may comprise a leading edge 309 formed on an initial impact zone 307 of the blade 203. The plurality of cutting elements 207 may be attached to the leading edge 309. The plurality of cutting elements 207 may be designed to ream the borehole wall 102. The plurality of cutting elements 207 may be positioned ahead of the leading edge 307. The leading edge 307 may be configured to contact the borehole wall 102 when the blade 203 is extended.

The leading edge 309 may comprise the plurality of sensors 204 grouped together in one unit. The blade 203 extending may rigidly hold the plurality of sensors 203 against the borehole wall 102. This may clarify readings by creating a solid connecting the plurality of sensors 204 to the borehole wall 102, yielding an undisrupted signal transmitting from the surrounding earthen formation to the plurality of sensors 204. The stiffening of the blade 203 from the wedging effect may stabilize the plurality of sensors 204 disposed on the blade 102, helping to increase signal continuity.

Figure 4:
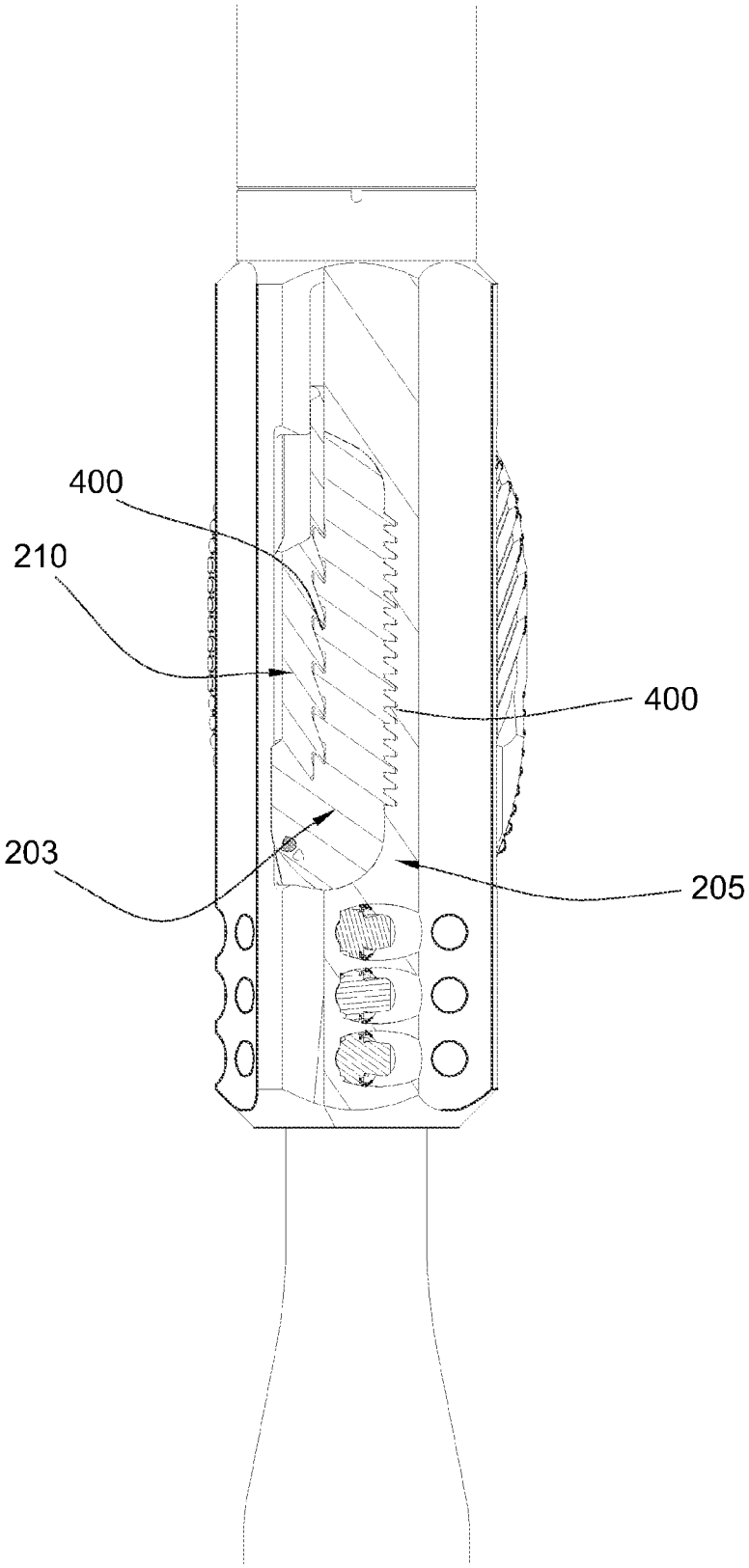
FIG. 4 is an orthogonal view of another embodiment of a downhole tool.

FIG. 4 discloses a partial cross sectional view of the fin 210, blade 203, and slidable sleeve 205. This embodiment depicts the slidable sleeve 205 fully translated; the blade 203 fully expanded, and the slide grooves 300, 301 disposed on the blade 203 locked in place through the wedging effect formed between the mandrel and sleeve protrusions 302, 303.

The sleeve protrusion 303 and the mandrel protrusion 302 may be configured to produce an increasing wedging effect on the slide grooves 300, 301 as the blade 203 expands. The sleeve and mandrel protrusions 302, 303 may remain consistently distant from the mandrel's axis 305 while the blade 203 expands away from and retracts toward the mandrel's axis 305. The blade 203 may be forced outward by the sleeve and mandrel protrusions' connection 400 with the exterior and interior slide grooves, respectively, and a solidity of the connection 400 may increase linearly as the blade 203 expands.

The fin 210 may be configured to immobilize the interior slide groove 300 when the blade 203 is in a locked position. The blade 203 may not be able to move left, right, up, or down, with respect to this view of the cross sectioned blade, due to the tight connection 400 between the mandrel protrusion 302 and the interior slide groove 300. The fin 210 may be configured to immobilize the interior slide groove 300 when the blade 203 is in a locked position. Immobilizing the blade 203 with respect to the mandrel 202 may result in decreased stresses due to the rigidity of the expandable tool 107. Immobilizing the blade 203 may also decrease shaking of the blade 203 during drilling operations. Shaking during operation may cause added stress on the interior and exterior slide grooves 300, 301 as well as creating an excess pressure on the plurality of cutting elements 207. Relieving the added stress in a base of the blade 203 and the pressure from the front of the blade 203 and the plurality of cutting elements 207 may increase the life of the tool 107.

Figure 5:
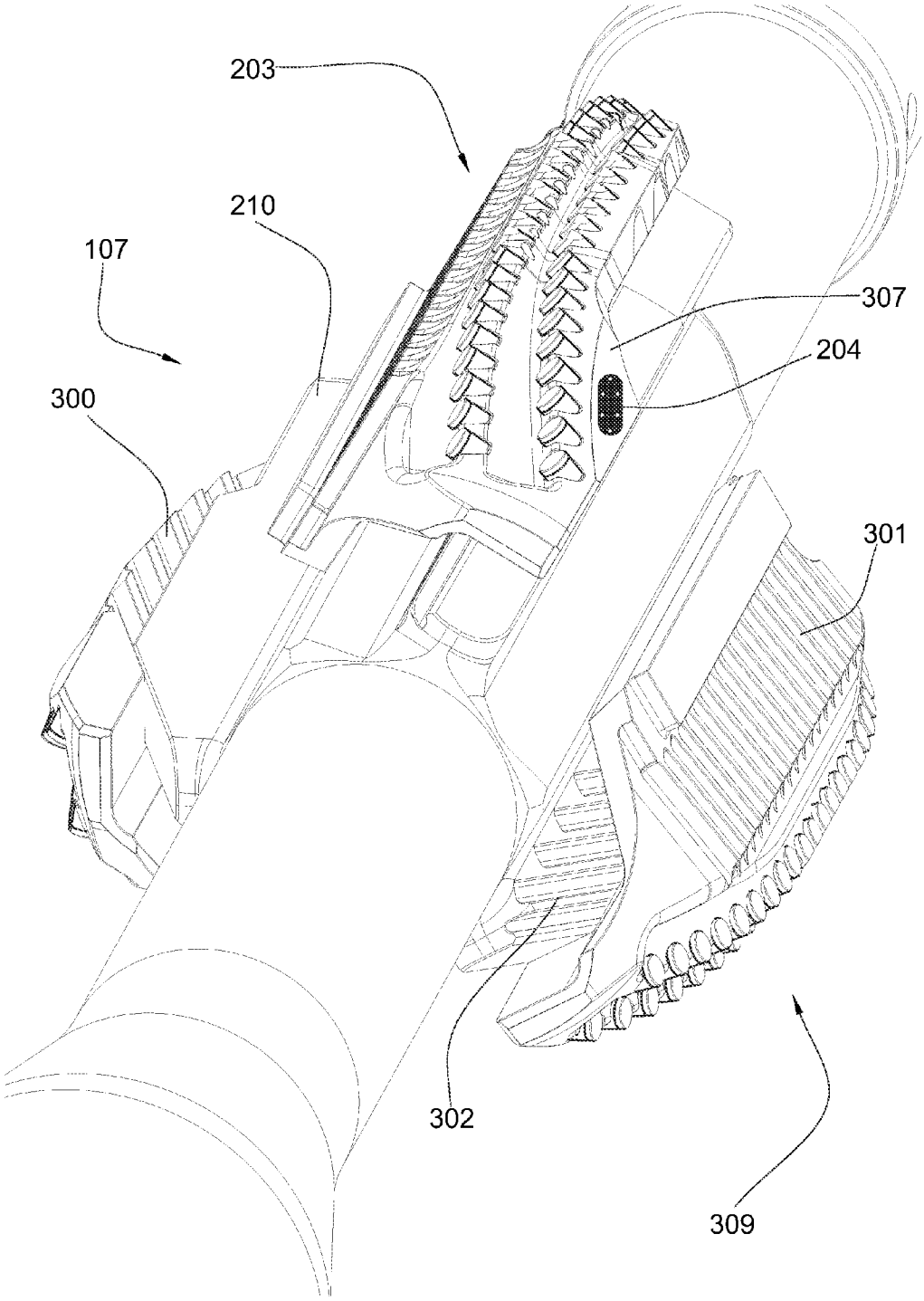
FIG. 5 is an exploded view of another embodiment of a downhole tool.

FIG. 5 discloses an embodiment of the expandable tool 107 with the slidable sleeve 205 removed. The blade 203 is attached to the mandrel 202 through the interior groove 300 on the blade 203 and the mandrel protrusion 302. The plurality of sensors 204 lies on the leading edge 309.

The plurality of sensors 204 disposed on the leading edge 309 may comprise a variety of sensors configured to sense seismic and/or sonic waves 104 and determine physical characteristics in earthen formations 105. The plurality of sensors 204 may consist of a one component geophone, a three-component geophone, an accelerometer, a hydrophone, a vibrometer, a laser-doppler vibrometer, a miniature electro-mechanical system, or combinations thereof.

The leading edge 307 may be configured to abut the borehole wall 102 during the drilling process. The plurality of sensors 204 may be distributed along a radius of curvature similar to a radius of curvature of the leading edge 307. In some embodiments, the plurality of sensors 204 may be placed evenly about the leading edge 307 to better receive the sonic and/or seismic waves 104 directed through the earthen formation 105.

The present invention increases the quality of measurements taken by the sensors. Prior art reamers blades were not secured as rigidly to the formation or the bore wall as their the present invention is through the wedging effect. The wedging effect's ability to increase the rigidity of the blade improves the blades connection with the formation, thereby, improving the sensor quality.

Figure 6:
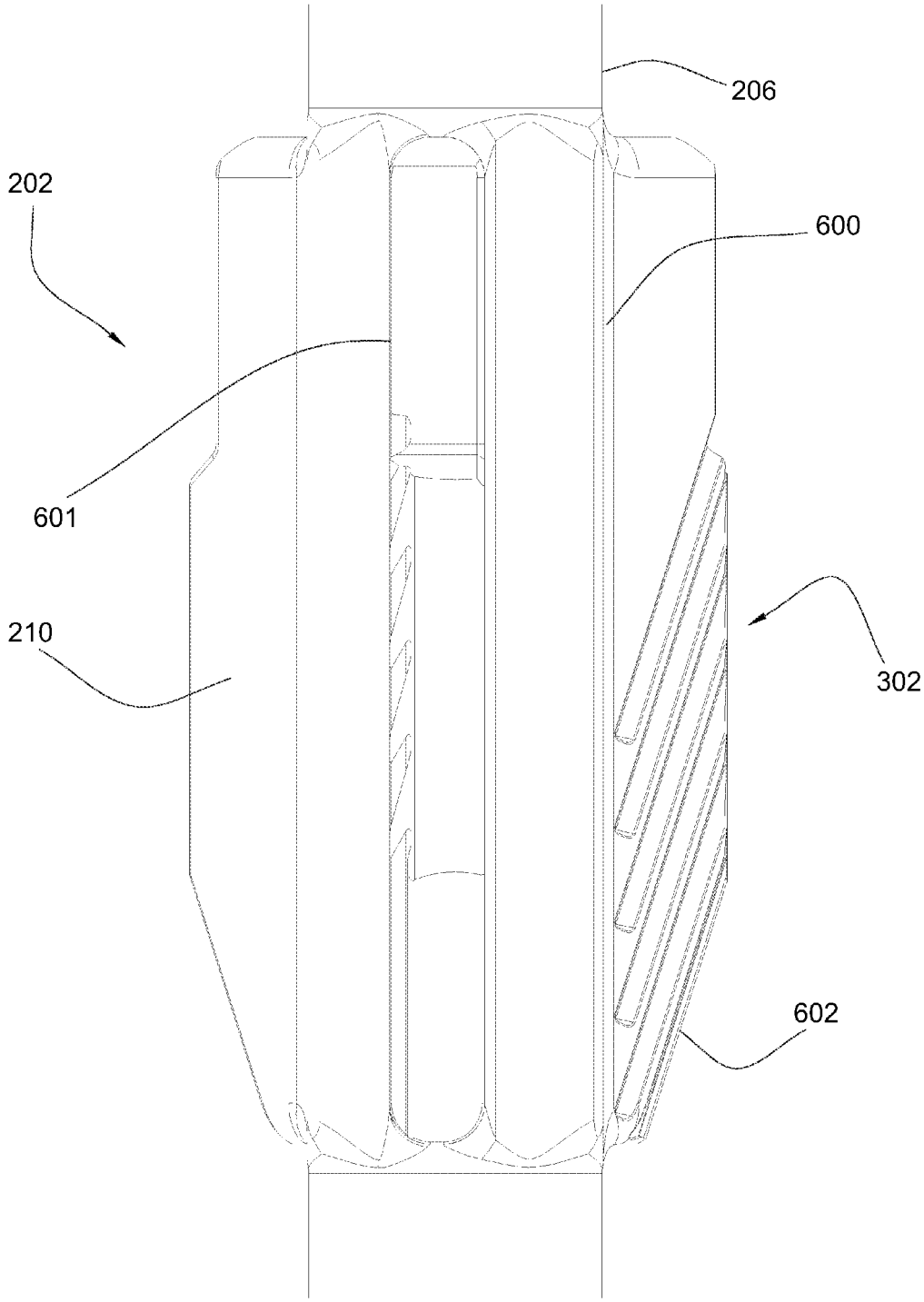
FIG. 6 is an orthogonal view of another embodiment of a downhole tool.

FIG. 6 discloses an embodiment of the mandrel 202 comprising a tubular component and the fin 210. In this embodiment, fins 210 are disposed equally spaced about the mandrel 202, extending from the outer surface of the mandrel 202, and comprising the mandrel protrusion 302.

The fin 210 may be formed on the outer surface of the mandrel 206. A base of the fin 600 may be the portion of the fin 210 that contacts the tubular mandrel and the fin 210 may extend outward from the base 600 toward the blade 203.

The mandrel protrusion 302 may be placed on a leading portion of the fin 210. The leading portion of the fin 210 may refer to the portion of the fin 210 that faces forward during mandrel's rotation. In this embodiment, the face of the fin 601 may be to the left of the front fin as the mandrel 202 may be configured to rotate toward the left. The mandrel protrusion 302 may begin at the outer edge of the fin 210 and travel toward the axis at some angle $\alpha$ until reaching the base of the fin 600.

The fin 210 may assist the slidable sleeve 205 in extending the blade 203 outward as the slidable sleeve 205 is shifted along the mandrel 202. It is believed that the fin 210 may increase the stiffness of the expandable tool 107 by supporting the blade 203 from underneath. The fin 210 also helps to strengthen the expandable tool 107 as the fin 210 negates the need for cavities in the mandrel 202. Supporting the blade 203 may result in a steady connection between the plurality of sensors 204 and the borehole wall 102. As stress is applied to the blade 203 during normal drilling operations the fin 210 may act to support the blade 203, thus, decreasing the likelihood of failure.

The blade 203 may contact the fin 210 through the interior slide groove 300 on the blade 203 and the mandrel protrusion 302 on the fin 210. Another area of contact for the two components may be a portion of the interior surface of the blade 203 and an outward face of the fin 601. The interior surface of the blade 203 may be disposed on the blade opposite the leading edge 307. The area on the fin 601 may be a face consisting of an angle similar to the angle that the mandrel protrusion 302 makes with the axis. As the blade 203 expands and retracts, the portion of the interior surface of the blade 203 opposite the leading edge 307 may be configured to slide along an outward face of the fin 601.

To facilitate sliding, the interior surface of the blade 203 and the outward face of the fin 601 configured to slide along each other may have the same angle with respect to the mandrel's axis. This may allow the fin 210 to further support the blade 203 during operation.

Figure 7:
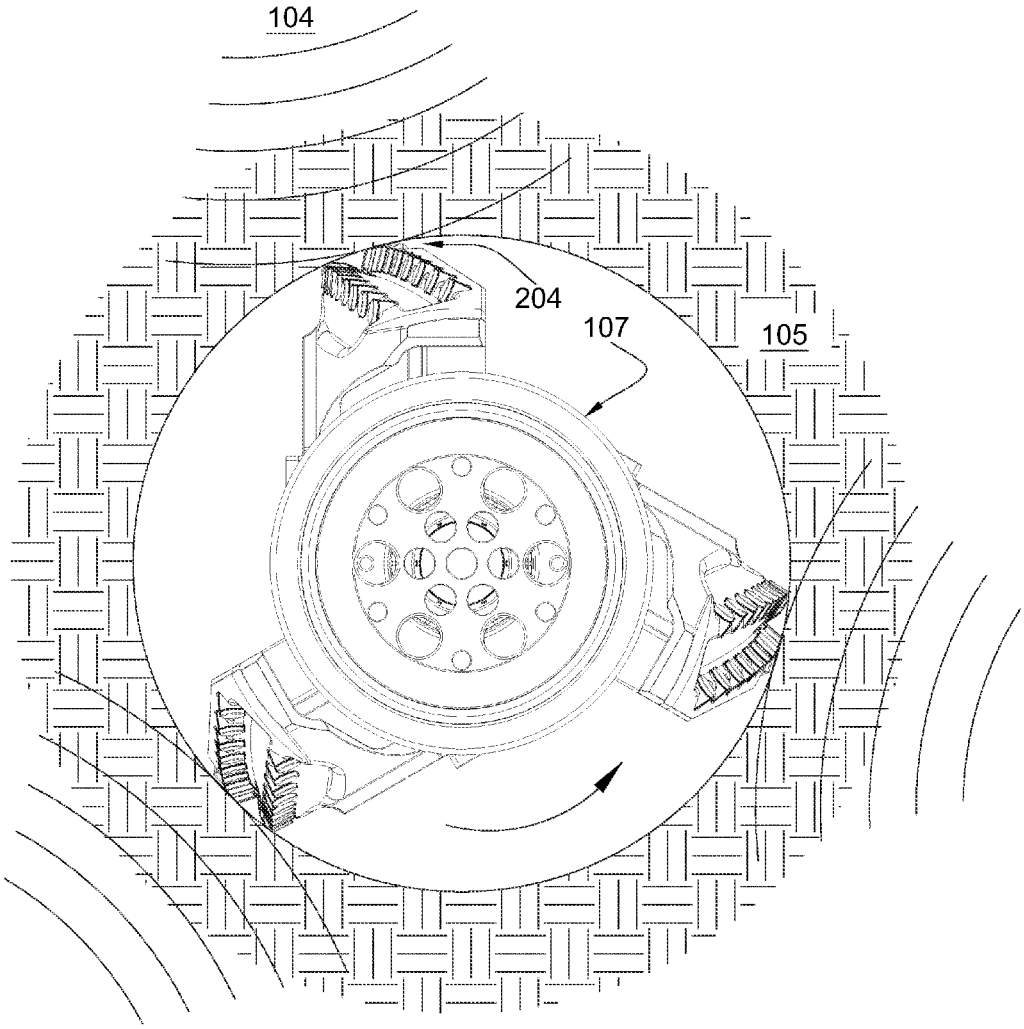
FIG. 7 is an orthogonal view of another embodiment of a downhole tool.

FIG. 7 discloses an embodiment of the invention in a downhole environment with seismic and/or sonic waves 104 in the earthen formation 105. In this embodiment, the expandable tool 107 is configured to travel in the counter clock-wise direction. The blade 203 is fully expanded and the cutting elements 207 are engaging the earthen formation 105. Also, a source may be adapted to generate seismic or sonic waves 104, including; a thumper truck, an explosive, an air gun, a vibrator, a sparker, or a mechanical wave generator such as a downhole hammer, jar, etc. The source may be located at the surface, in a cross well, or along the tool string that comprises the expandable tool. The plurality of sensors 204 may receive the waves 104, translate them to data, and send the data through the downhole tool string to the computer or data logging system 108 on the surface.

The cutting elements 207 may be configured to ream the borehole wall 102 in an annular fashion when the expandable tool 107 is expanded and the wedging effect is formed. The cutting elements 207 may scrape away a layer of the borehole wall 102 surface before the expandable tool 107 clamps to the borehole wall 102. It is believed that this scraping of the surface of the borehole wall 102 may clean the wall, thus further clarifying the readings from the plurality of sensors 204.

The wedging effect may increase the strength of a relationship between the base of the blade 203 and the mandrel 202. Increasing the relationship at the base of the blade 203 may allow the expandable tool 107 to remain stiff under greater strains. This may allow the blade 203 to expand outward further than in previous embodiments. Extending the blade 203 further may increase the pressure of the leading edge 307 against the borehole wall 102. The plurality of sensors 204 disposed the face of the leading edge 307 may also be pressed harder against the borehole wall 102 and may result in the plurality of sensors 204 receiving waves 104 clearer through the earthen formation 107. This may result in better approximations of the earthen formation's physical characteristics.

The pressure of the leading edge 307 against the borehole wall 107 may help to create a constant, steady receiving environment for the plurality of sensors 204. The amount of chatter and vibration in the mandrel 202 may be decreased. With less chatter and vibration, automating the slidable sleeve 205 may be simplified. A low power electrical control system may be configured to shift the blade 203. The electrical control system may be disposed within the drill string and may include fewer parts than is currently used in automation devices.

Figure 8:
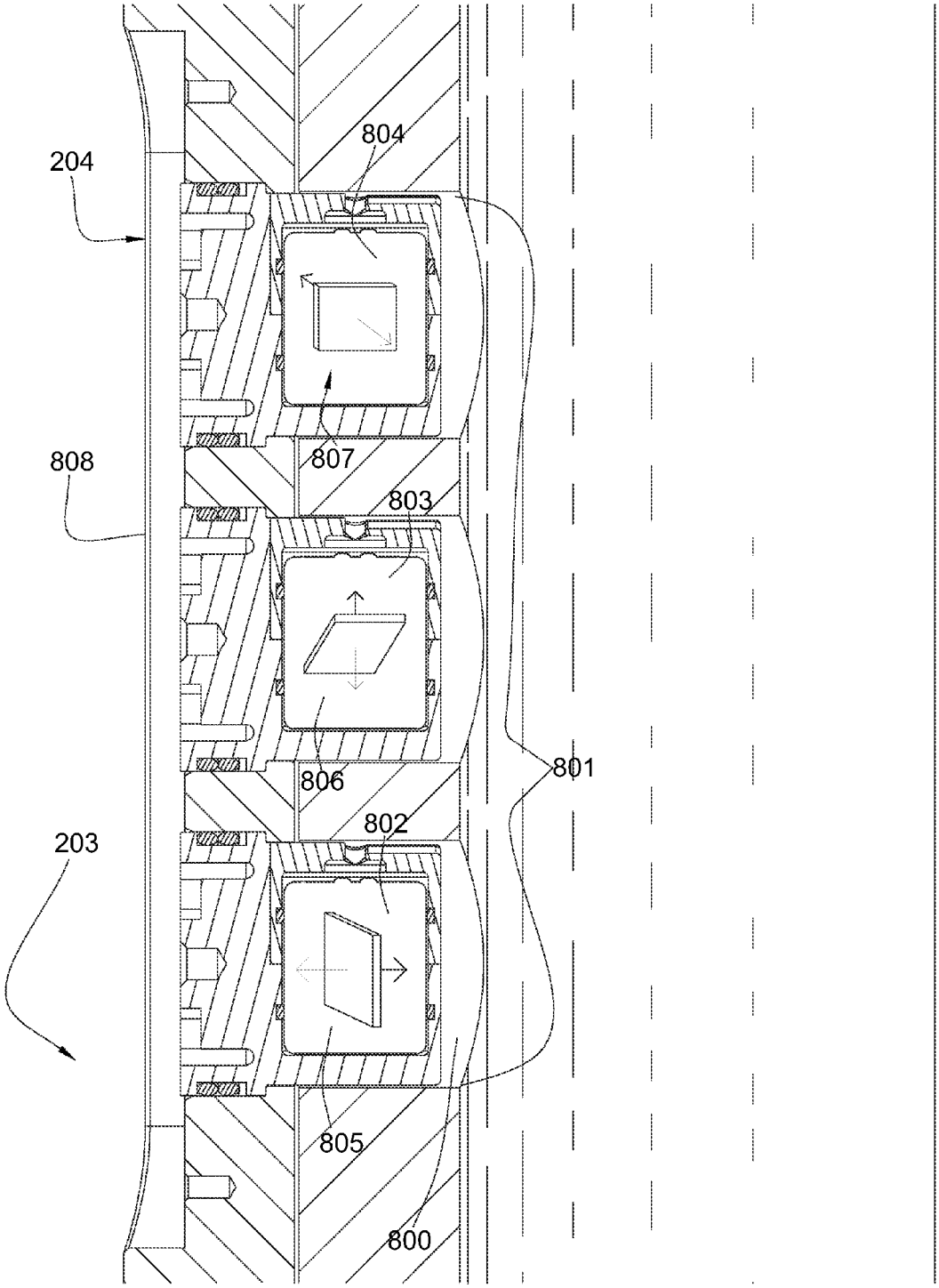
FIG. 8 is a cutaway view of an embodiment of a three component geophone.

FIG. 8 discloses a cross-sectional diagram of a plurality of sensors 204 integrated into the blade 203. In this embodiment, the plurality of sensors 204 may be a three component geophone 801, which may comprise three one component geophones 802, 803, 804. The blade 203 may comprise a pocket 800 adapted to comprise three downhole sensors 802, 803, 804 wherein each sensor receives signals on different orthogonal axes. The three component geophone 801 in this embodiment may be adapted to receive and measure signals in the Z 805, Y 806, and X 807 directions, respectively, in a three dimensional coordinate system. It may be beneficial to incorporate the three-dimensional downhole sensor 801; the data from which may aid drillers to more accurately steer the downhole drill string.

The plurality of sensors 204 may be rigidly attached to the face of the blade 203 through a plurality of attaching devices. Rigidly attaching the plurality of sensors 204 to the face of the blade 203 may result in the plurality of sensors 204 maintaining a firm grip with the borehole wall 102 when the expandable reamer 107 expands the blade 203. The plurality of sensors 204 may be pressed into the borehole wall 102 and may continue to receive waves 104 through the earthen formation 105 while remaining attached to the blade 203 and sending data through the downhole drill string to the computer or data logging system 108.

A face of the plurality of sensors 808 may be nearly flush with the face of the leading edge 307 located on the blade 203. The plurality of sensors 204 may comprise a hard exterior surface configured to contact the borehole wall 102. The plurality of sensors 204 may be set into the face of the blade 203 and the blade 203 may surround and support the plurality of sensors 204. Surrounding the plurality of sensors 204 by the blade 203 may increase the pressure and stress that the plurality of sensors 204 may be able to withstand in the downhole environment. Also, the face of the blade 203 may contact the borehole wall 102 with nearly the same force as the plurality of sensors 204, thereby relieving a pressure felt on the face of the plurality of sensors 204.

Waves 104 generated by the source may propagate through the earthen formation 105 until they encounter a change in acoustic impedance, which causes a reflection. The plurality of sensors 204 may then receive the combination of direct and reflected waves and determine the surrounding earthen formation's physical characteristics.

Figure 9:
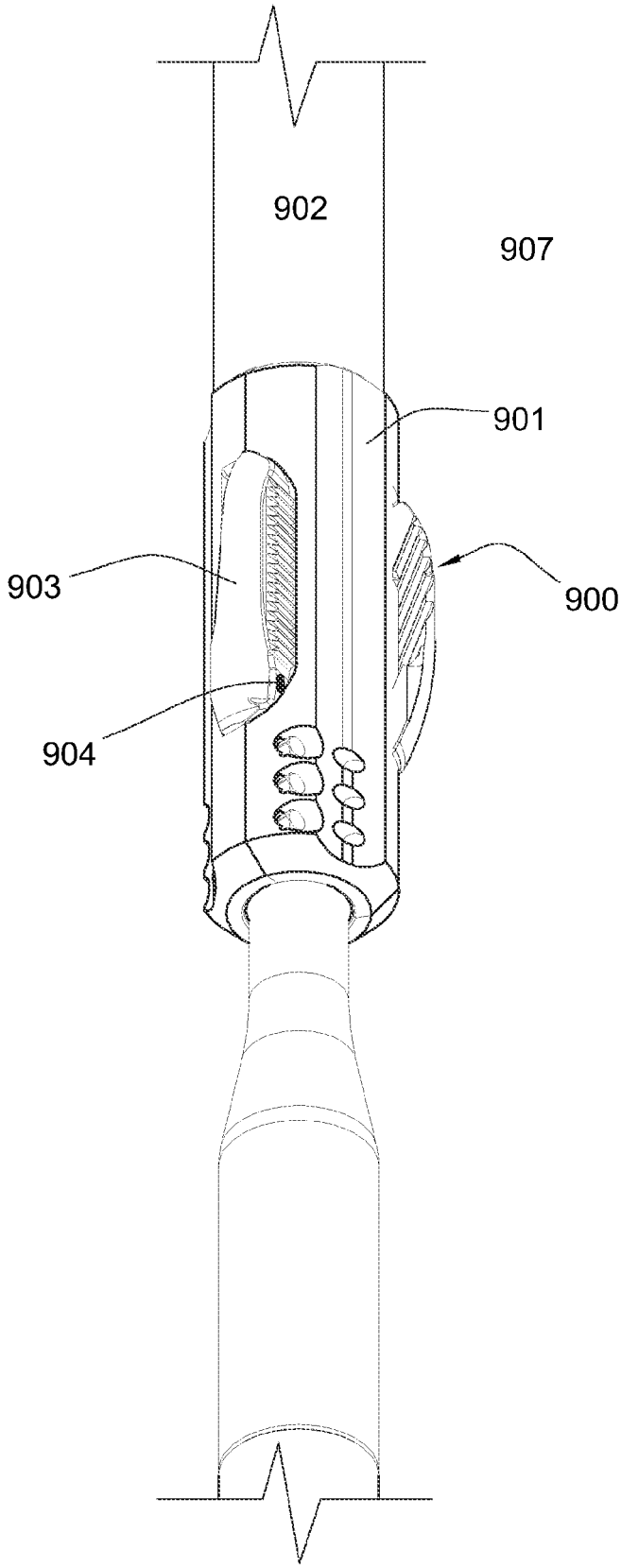
FIG. 9 is an orthogonal view of another embodiment of a downhole tool.

FIG. 9 discloses a perspective view of an embodiment of a downhole component comprising an expandable tool 907. The expandable tool 907 may comprise a mandrel 902, a blade 900, and a slidable sleeve 901. The blade 900 may comprise a flat edge 903. The flat edge 903 may be configured to engage an earthen formation to stabilize the mandrel 902 during normal drilling operations. While the flat edge 903 is engaged with the formation the plurality of sensors 904 disposed thereon may contact the borehole wall, sense waves in the earthen formation, and transmit the data to surface equipment.

Whereas the present invention has been described in particular relation to the drawings attached hereto, it should be understood that other and further modifications apart from those shown or suggested herein, may be made within the scope and spirit of the present invention.

What is claimed is:

1. An expandable tool for an earth boring system, comprising;

a mandrel comprising a tubular body with an outer surface;

a sleeve is positioned around the outer surface and comprises a blade disposed in a slot formed in the thickness of the sleeve;

the sleeve is also configured to slide axially along a length of the tubular body;

the blade comprises an interior slide groove located on an interior blade surface and an exterior slide groove located on an exterior blade surface;

a sleeve protrusion of the sleeve is configured to extend into the interior slide groove, a mandrel protrusion of the outer surface of the mandrel is configured to extend into the exterior slide groove;

the blade is configured to shift laterally out of the slot as the sleeve slides axially;

wherein the interior and exterior slide grooves are oriented at different angles and as the sleeve slides axially along the length of the mandrel, the slide grooves lock the blade in a pre-determined position through a wedging effect.

2. The system of claim 1, wherein a difference in angles between the sleeve protrusion and the mandrel protrusion contributes to the wedging effect.

3. The system of claim 1, wherein the wedging effect is configured to stiffen a connection between the slide grooves and the protrusions, holding the blade rigid.

4. The system of claim 1, wherein the wedging effect is configured to increase pressure of the blade against a borehole wall.

5. The system of claim 4, wherein a low power electrical control system is configured to shift the blade.

6. The system of claim 1, wherein the blade comprises an leading edge formed on a initial impact zone of the blade.

7. The system of claim 6, wherein the leading edge comprises a plurality of sensors.

8. The system of claim 7, wherein the plurality of sensors are embedded within a face of the leading edge.

9. The system of claim 7, wherein the plurality of sensors is distributed along a radius of curvature similar to a radius of curvature of the leading edge.

10. The system of claim 1, wherein the mandrel comprises a fin that is formed on the outer surface of the mandrel and extends outward towards the blade.

11. The system of claim 10, wherein the mandrel protrusion is formed on a surface of the fin.

12. The system of claim 10, wherein the fin is configured to immobilize the interior slide groove when the blade is in the locked position.

13. The system of claim 10, wherein a portion of the interior surface of the blade is configured to slide along an outward face of the fin.

14. The system of claim 13, wherein the interior surface of the blade and the outward face of the fin are configured to be the same angle with respect to the mandrel's axis.

15. The system of claim 1, wherein the exterior slide groove and the sleeve protrusion are angled between 70 and 110 degrees with respect to an axis of the mandrel.

16. The system of claim 1, wherein the interior slide groove and the mandrel protrusion are angled between 10 and 30 degrees with respect to an axis of the mandrel.

17. The system of claim 1, wherein the sleeve protrusion and the mandrel protrusion are configured to produce an increasing wedging effect on the slide grooves as the blade expands.

* * * * *